United States Patent [19]

Gay

[11] 4,114,309

[45] Sep. 19, 1978

[54] TOY HELICOPTER

[75] Inventor: Derek John Gay, Rancho Palos Verdes, Calif.

[73] Assignee: Mattel, Inc., Hawthorne, Calif.

[21] Appl. No.: 749,737

[22] Filed: Dec. 13, 1976

[51] Int. Cl.[2] ..... A63H 27/12

[52] U.S. Cl. ..... 46/75; 46/47; 46/39; 46/1 H

[58] Field of Search ..... 46/74 R, 75, 78, 82, 46/84, 69, 48, 49, 50, 51, 52, 39, 40, 47, 59, 1 H; 244/17.11; 192/41 S, 92, 89 R

[56] References Cited

U.S. PATENT DOCUMENTS

| | | | |
|---|---|---|---|
| D. 161,621 | 1/1951 | Halvas | D34/15 |
| 197,177 | 11/1877 | Robinson | 122/448 A |
| 613,766 | 11/1898 | Hodgkinson | 192/41 S |
| 2,642,698 | 5/1948 | Fishburne | 46/75 |
| 3,001,763 | 9/1961 | Pilot | 46/40 |
| 3,400,486 | 9/1968 | Strauss | 46/176 |
| 3,450,239 | 6/1969 | Ryan et al. | 46/185 |
| 3,608,234 | 9/1971 | Davidson | 46/47 |

*Primary Examiner*—Louis G. Mancene
*Assistant Examiner*—Mickey Yu
*Attorney, Agent, or Firm*—John G. Mesaros; Max E. Shirk; Stephen L. King

[57] ABSTRACT

A toy helicopter having a hollow body member configured to simulate a helicopter with a main body portion and a tail section, the main body portion supporting a helicopter rotor on a shaft member extending through the roof thereof, the shaft being rotatably supported by a pair of bearings, with a reel portion configured in the shaft intermediate the bearings. The reel portion has encircled thereabout a flat constant torque coil spring acting as a spring clutch, the free end of the coil spring being secured to one end of a trigger member, which is pivotally secured within the housing. The main body portion is provided with a pair of aligned openings through which an operator can manipulate the trigger whereupon repeated pivoting of the trigger causes the shaft to continuously rotate in a given direction. The helicopter is also provided with a hand-operated winch and a water-squirting apparatus actuated by a second trigger.

6 Claims, 3 Drawing Figures

10
12
14
16
18
20
22
24
26
28
30
32
34
36
38
40
42
44
46
48
50
52
54
56
58
60
62
64
66
68
70
72
74
2
3

TOY HELICOPTER

BACKGROUND OF THE INVENTION

The background of the invention will be discussed in two parts:

1. Field of the Invention

This invention relates to toys and more particularly to a toy simulating a helicopter having manually operable means for driving the rotor blades in a compact reliable manner with few moving parts.

2. Description of the Prior Art

Toys simulating airplanes or helicopters having moving blades or propellers are a constant source of amusement to children. The play value of such a device is enhanced when the action of such toys closely approximates those available in the full-scale operating versions.

A toy helicopter is shown in U.S. Pat. No. 2,642,698 issued June 23, 1953 to E. W. Fishburne, the helicopter being provided with a hollow shaft supporting the rotor blades, the hollow shaft having extending therethrough a drawstring which is wound about a drum on a second shaft, the drum being coil spring biased. The drum carries a frictional clutch which engages an inner cylindrical surface of a gear member which is coupled to the rotor shaft. Such mechanisms are unduly complicated and the play value is limited to the actuation of the pullstring to drive the rotor blade.

It is accordingly an object of this invention to provide a new and improved toy helicopter having a simple, compact rotor blade actuating mechanism.

It is another object of this invention to provide a new and improved toy helicopter which contains additional play value in the form of a manually-operated winch and a manually-operable water-squirting mechanism simulating a firehose.

SUMMARY OF THE INVENTION

The foregoing and other objects of the invention are accomplished by providing a toy helicopter having a hollow body member with a main body portion and a tail section, the rotor blades thereof being supported by a shaft rotatably mounted to the main body portion by a pair of bearings. Intermediate the bearings the shaft is configured in the form of a reel and a oneway spring clutch has a flat constant torque coil spring encircling the reel, the other end of the coil spring being secured to one end of a trigger member, the other end of the trigger member being pivotally secured within the housing. A pair of aligned openings are provided in the helicopter main body portion to permit an operator to grasp the trigger member for repeated pivoting thereof, the unwinding of the coil spring resulting in frictional engagement of the reel by the spring upon movement of the trigger in one direction only, the trigger being returned toward the shaft by the inherent rewinding of the coil spring whereby to rotate the shaft in one direction only. The helicopter is also provided with a manually-operated winch and a water-squirting apparatus simulating a firehose and actuated by a second trigger member.

Other objects, features and advantages of the invention will become apparent upon a reading of the specification when taken in conjunction with the drawings.

DESCRIPTION OF THE PREFERRED EMBODIMENT

Figures 1, 2:
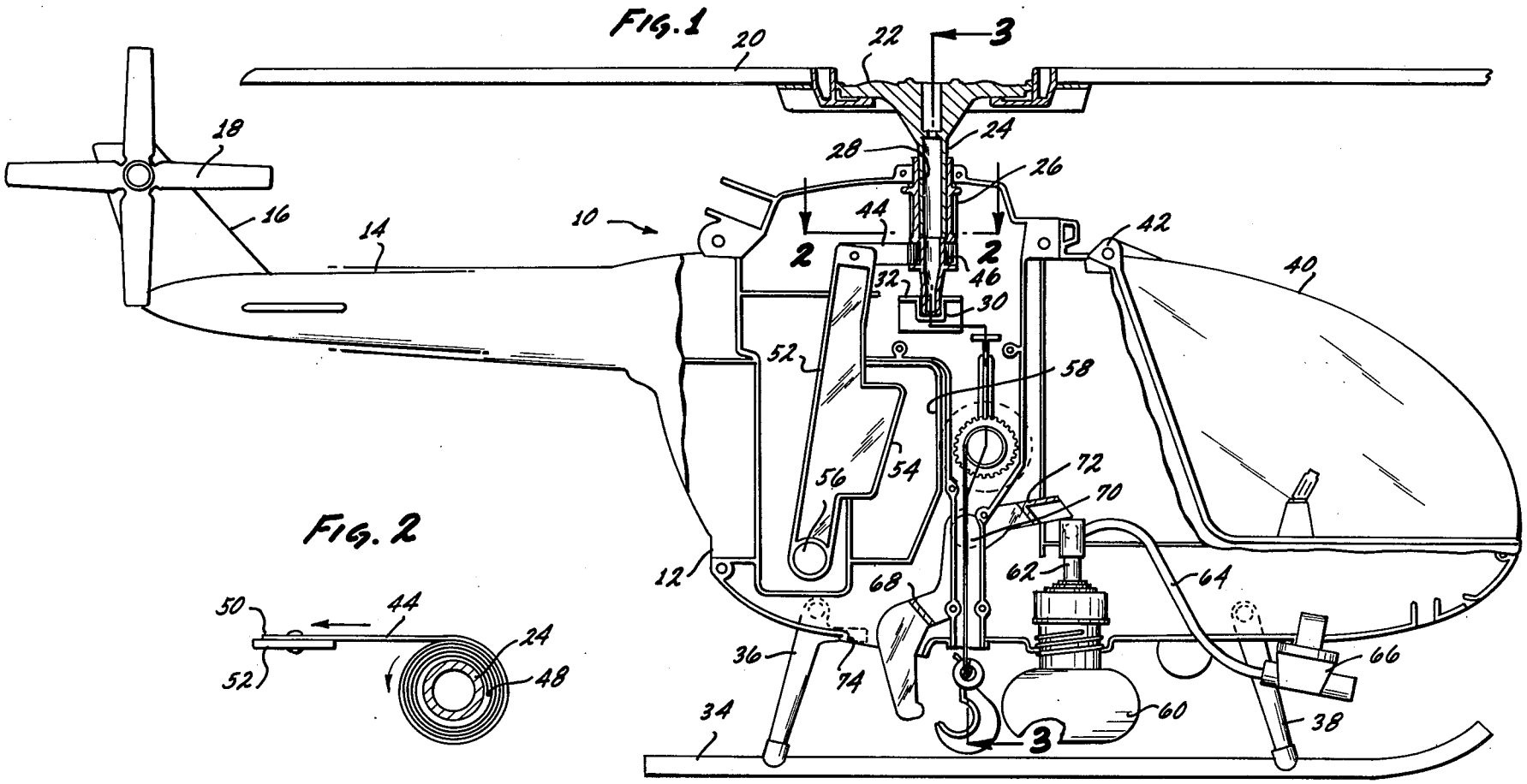
FIG. 1 is a side elevational view, partially broken away, of the toy helicopter according to the invention.
FIG. 2 is an exaggerated sectional view taken along line 2—2 of FIG. 1.

Referring now to the drawings and particularly to FIG. 1 there is shown a toy helicopter according to the invention, comprising a hollow body member generally designated 10 having a main enlarged body portion 12 and a rearwardly extending tail section 14, the tail section 14 having a cross-sectional configuration substantially less than the main body portion 12 and extending along a given line rearwardly thereof. At the terminal end of the tail section 14 there is provided an upwardly extending member 16 supporting a tail propeller 18.

A simulated helicopter rotor blade assembly 20 is provided and is secured to the hub portion 22 of a propeller shaft 24, the rotor being adapted to rotate in a generally horizontal plane with the shaft 24 rotating about an axis transverse to a longitudinal line extending through the tail section 14. The propeller shaft 24 is rotatably mounted to the main body portion 12 of the helicopter by insertion through a first bearing member 26 which is positioned in an aperture 28 in the roof of the main body portion. A second bearing member 30 is provided on the interior of the main body portion 12, bearing 30 being effectively a thrust bearing configured in a channel 32 extending transversely between opposing sidewalls of the main body portion 12.

The main body portion 12 has affixed to the bottom thereof a pair of skids 34 (only one of which is shown) supported by suitable strut members 36 and 38 which are secured to the main body portion 12. The general overall configuration of the toy helicopter approximates that of the conventional helicopter utilized for emergency usage such as firefighting or the like. Covering the front-end of the main body portion 12 is an enlarged clear plastic cockpit dome 40 which is pivotally hinged adjacent the roof portion by hinge means 42 which enables the cockpit 40 to be opened to insert a toy figure if desired.

The helicopter rotor blades 20 are actuated by means of a one-way spring clutch mechanism which includes a Negator type constant torque flat coil spring 44 which encircles a reel 46 formed in shaft 24 at a position intermediate bearings 26 and 30. As shown in FIG. 2 the coil spring 44 encircles the shaft 24 but is not secured thereto, the inner end 48 of the coil spring being unattached. The outer or free end 50 of coil spring 44 is suitably secured to a trigger member 52 which is generally bar shaped having an enlarged mid-portion forming a trigger 54 with the lower end of trigger member 52 being pivotally secured by a shaft 56 inside the main body portion 12.

In operation the coil spring 44 when fully coiled has an inner diameter slightly larger than the outer diameter of reel 46, and the natural tendency of the spring 44 is to remained coiled. As the trigger member 52 is pivoted in a counterclockwise direction as viewed in FIG. 1 and to the left as indicated by the arrow in FIG. 2, the inner surface of the coil of spring 44 frictionally engages the adjacent circular reel surface of reel 46 to thereby rotate shaft 24 in a counterclockwise direction as indicated by the arrow adjacent to the coil. When the trigger member 52 is released the trigger member 52 is pivoted in a clockwise direction as viewed in FIG. 1 being returned to the position shown under force of the bias provided by the recoiling of spring 44 while simultaneously shaft 24 continues to rotate in the same counterclockwise direction as viewed in FIG. 2. Upon repeated pivoting of the trigger member 52 the shaft 24 is alternately frictionally engaged and disengaged to provide a continuous rotation of the rotor blades 20 in a single direction.

To provide access to the trigger member 52 and the trigger 54 thereof, the main body portion 12 is provided with a pair of aligned openings 58 (only one of which is shown) which are on opposite sidewalls of the main body portion 12 in proximity to the trigger 54, the openings 58 being so configured and so positioned that in combination with the immediately rearward surface of the main body portion 12 a pistol grip effect is accomplished whereby the operator can grip the toy by placing a hand under the tail section 14 to hold the toy in a manner similar to holding a toy pistol.

As shown in FIG. 1 to enhance the amusement value of the toy helicopter a water-squirting apparatus is provided and includes a water reservoir 60, the bottom of which is configured to simulate a pod of the type that would be carried by a helicopter engaging in firefighting missions. The reservoir 60 has inserted therein a depressible spring-operated pump 62 which has the outlet thereof connected to a hose 64 to terminate in a nozzle 66 for dispensing of the water, the nozzle 66 being suitably secured to the underside of the front-end of the main body portion 12. Operation of the pump 62 is effected by a suitable second trigger 68 which is pivotally mounted about a shaft 70 to one side of the center of the interior of main body portion 12. The trigger 68 is provided with an offset actuating arm 72 which engages the upper end of pump 62, the other end of trigger 68 being configured to fit through an elongated slot 74 in the under belly of main body portion 12 generally at a position below the opening 58 to permit an operator to actuate trigger 68 as an alternative to actuation of trigger 52 or simultaneously therewith by utilization of the little finger. In this manner with the trigger 68 in proximity to the rotor actuating trigger 52 simultaneous action can be obtained with movement of the rotor blades 20 and actuation of the water dispensing apparatus. Suitable means are provided for permitting the user to remove the water reservoir 60 for refilling.

Figure 3:
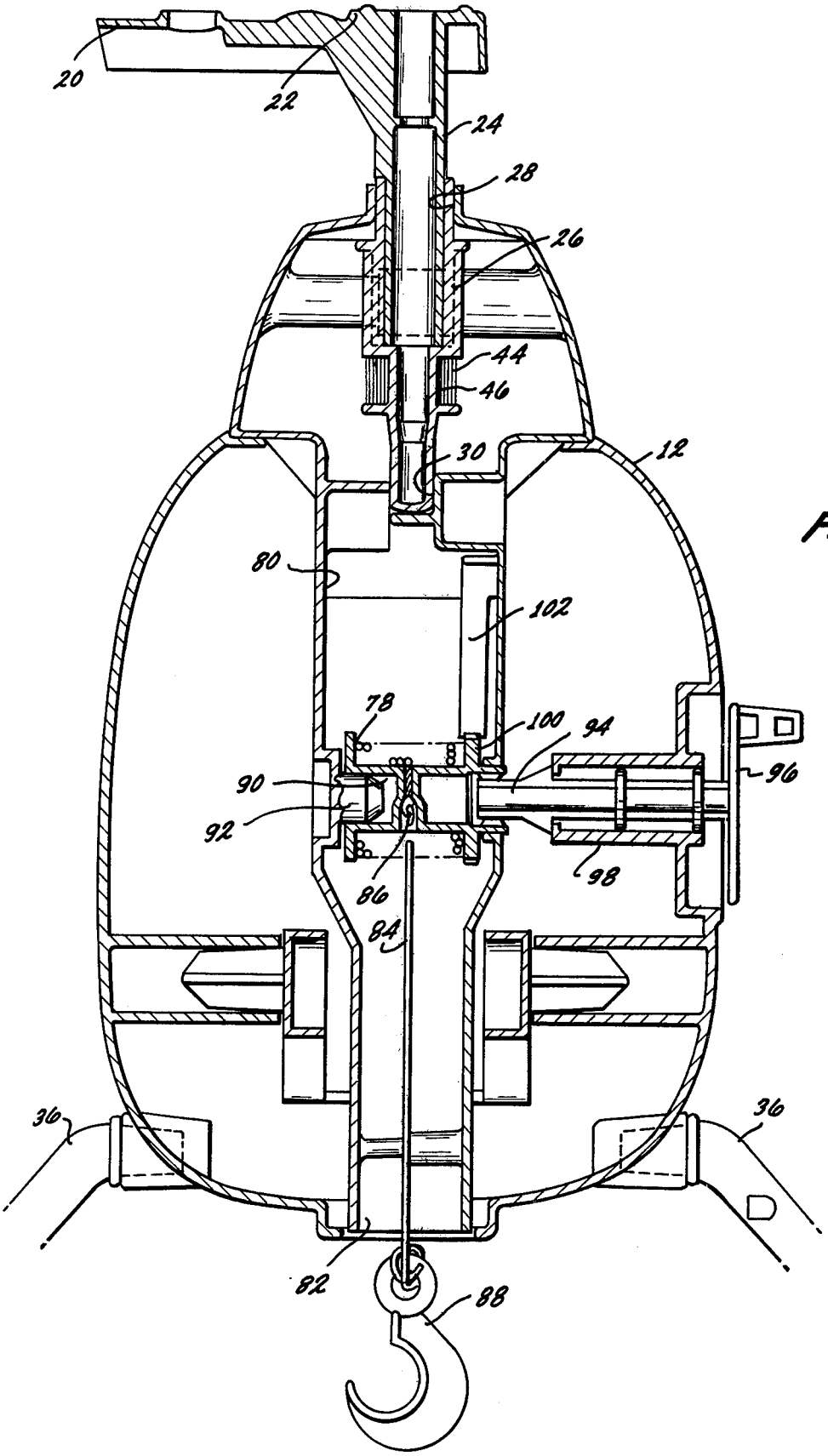
FIG. 3 is a cross-sectional view of the toy helicopter taken along line 3—3 of FIG. 1.

As shown in FIGS. 2 and 3 to additionally simulate an emergency type helicopter, the toy is provided with a manually-operated winch assembly which includes a take-up spool 78 mounted for rotation about an axis generally perpendicular to the axis of rotation of propeller shaft 24. The interior of main body portion 12 is provided with a vertically extending tunnel-like portion 80 which extends in a line generally parallel to the axis of shaft 24, the tunnel 80 terminating at its lower end in an opening 82 through which passes the take-up cord 84 which is suitably secured at one end to the spool 78 as indicated at 86 and wound thereabout to terminate exteriorly of the opening 82 in a hook 88. The spool 78 is provided with a cylindrical opening 90 which is received by a bearing projection 92 integrally formed in one side of the wall of tunnel 80, the other end of spool 78 being suitably secured to a shaft 94 which terminates in a winch handle 96 externally of the sidewall of main body portion 12. The shaft 94 is suitably supported by bearing means 98 formed integral with the interior surface of the sidewall of main body portion 12.

In order to provide the sound associated with a winch assembly one flange 100 of the spool 78 is suitably detented about the periphery thereof to coact with a blade-like spring member 102 formed integrally with the adjacent interior wall of tunnel 80, the spring 102 serving two purposes, one of which is to provide the sound associated with a winch, and the other being to maintain the hook 88 in position as desired. In operation the hook 88 is raised or lowered by rotation of handle 96, the winch mechanism being so positioned that a user of the toy can operate the rotor mechanism with one hand and the winch mechanism with the other to reenact a rescue mission.

Consequently, the helicopter toy utilizes a simple yet effective rotor operating mechanism with few moving parts which is compact, efficient and straightforward in construction and operation without being complicated. The helicopter additionally provides amusement value by the incorporation of a winch mechanism and water-squirting apparatus to enable the user to simulate functions associated with conventional firefighting helicopter units. While there has been shown and described a preferred embodiment it is to be understood that various other adaptations and modifications may be made within the spirit and scope of the invention.

What is claimed is:

1. In a toy helicopter, the combination comprising:

a hollow body member configured to simulate a helicopter and having a main body portion and a tail section extending outwardly therefrom along a given line;

a shaft having simulated helicopter rotor blades secured to one end thereof;

bearing means including a first bearing extending through an aperature in the upper surface of said main body portion and a second bearing within said main body portion for rotatably receiving said shaft for rotation about an axis transverse to said given line;

a reel portion on said shaft intermediate said first and second bearings;

a spring clutch including a flat constant torque coil spring encircling said reel portion, the surface of said coil spring adjacent said reel portion being adapted to frictionally engage said reel portion only during unwinding of said coil spring, said coil spring having a free end;

an elongate generally bar-shaped trigger member pivotally mounted at one end thereof within said main body portion, the other end thereof being secured to the free end of said coil spring, said trigger member having an enlarged trigger portion; and a pair of aligned openings in said main body portion, said openings and the surface of the main body portion immediately beneath the tail section being so configured and so positioned to form a pistol grip to permit access to and actuation of said trigger member by holding the toy by the pistol grip so formed, manual pivoting of said trigger member in a first direction to unwind said coil spring causing said spring to frictionally engage said reel portion to thereby rotate said rotor blades in a given direction, said trigger member being pivoted in the opposite direction under the force of said coil spring rewinding.

2. The combination according to claim 1 wherein said main body portion further includes manually operated winch means mounted therein and operable externally of said main body portion.

3. The combination according to claim 2 wherein said main body portion includes a tunnel-like section formed therein on a line generally parallel to the axis of rotation of said shaft, and said winch means includes a spool rotatably mounted in said tunnel-like section with a cord wound thereabout terminating externally of said main body portion with a hook secured to said cord.

4. The combination according to claim 3 wherein said tunnel-like section has formed integrally therewith a blade spring member and said spool is provided with a flange having detent means about the periphery thereof, said detent means coacting with said blade spring member whereby to retain said spool in a given position.

5. The combination according to claim 1 wherein said toy helicopter further includes water dispensing means mounted at least partially within said main body portion.

6. The combination according to claim 5 wherein said water dispensing means includes a spring actuated water pump and a second trigger member pivotally mounted at least partially within said main body portion, said second trigger member being configured to actuate said pump upon actuation of said trigger.

* * * * *